US009967640B2

(12) United States Patent
Albanese

(10) Patent No.: US 9,967,640 B2
(45) Date of Patent: May 8, 2018

(54) DEVICES, SYSTEMS, AND METHODS FOR VIBRATIONALLY SENSING AUDIO

(71) Applicant: Bodyrocks Audio Incorporated, San Francisco, CA (US)

(72) Inventor: Derek John Albanese, San Francisco, CA (US)

(73) Assignee: Bodyrocks Audio Incorporation, San Francisco, CA (US)

( * ) Notice: Subject to any disclaimer, the term of this patent is extended or adjusted under 35 U.S.C. 154(b) by 45 days.

(21) Appl. No.: 15/243,577

(22) Filed: Aug. 22, 2016

(65) Prior Publication Data

US 2017/0055055 A1 Feb. 23, 2017

Related U.S. Application Data

(60) Provisional application No. 62/207,819, filed on Aug. 20, 2015.

(51) Int. Cl.

| | |
|---|---|
| ***H04R 1/02*** | (2006.01) |
| ***G10L 25/21*** | (2013.01) |
| ***H04H 20/86*** | (2008.01) |

(52) U.S. Cl.

CPC ..... *H04R 1/028* (2013.01); *G10L 25/21* (2013.01); *H04H 20/86* (2013.01);

(Continued)

(58) Field of Classification Search

CPC .. H04R 1/00; H04R 2400/03; H04R 2430/03; H04R 3/00; H04R 9/063; G10L 25/21;

(Continued)

(56) References Cited

U.S. PATENT DOCUMENTS

| | | | |
|---|---|---|---|
| 8,686,941 | B2 | 4/2014 | Rank |
| 8,995,692 | B2 | 3/2015 | Efrati |

(Continued)

FOREIGN PATENT DOCUMENTS

| | | |
|---|---|---|
| CN | 103181198 A | 6/2013 |
| EP | 2612424 | 7/2013 |

(Continued)

OTHER PUBLICATIONS

International Search Report dated Oct. 31, 2016 from International Application PCT/US2016/048057, 2 pgs.

(Continued)

*Primary Examiner* — Lao Lun-See
(74) *Attorney, Agent, or Firm* — Aurora Consulting LLC

(57) ABSTRACT

A system for vibrationally sensing audio includes a vibration output device. The vibration output device includes a haptic actuator; a haptic actuator driver coupled to the haptic actuator; an antenna configured to communicatively receive a haptic pattern from a base unit; and a processor coupled to the antenna and haptic actuator driver. In some embodiments, a haptic pattern includes at least one frequency range. When a total audio power in at least one frequency range reaches a threshold, the processor activates the haptic actuator driver to drive the haptic actuator to produce vibration on a body surface of a user, an inanimate object surface, or a water surface. In some embodiments, the system further includes the base unit. The base unit includes a base unit processor configured to receive an audio signal from an audio emitting device and process the audio signal into the haptic pattern.

15 Claims, 12 Drawing Sheets

(52) U.S. Cl.
CPC .... *H04R 2201/023* (2013.01); *H04R 2400/03* (2013.01); *H04R 2420/07* (2013.01)

(58) Field of Classification Search
CPC .... G10L 21/06; H04N 5/23293; H04N 5/765; H04N 5/772; H04L 51/24; H04L 12/1895; H04L 67/22
USPC ..... 381/1–4, 333, 330; 700/94
See application file for complete search history.

(56) References Cited

U.S. PATENT DOCUMENTS

| | | | | |
|---|---|---|---|---|
| 9,318,940 | B2 | 4/2016 | Efrati | |
| 2003/0067440 | A1* | 4/2003 | Rank | G06F 3/016 345/156 |
| 2009/0325647 | A1* | 12/2009 | Cho | H04M 1/72519 455/567 |
| 2012/0035513 | A1 | 2/2012 | Afshar | |
| 2012/0206247 | A1* | 8/2012 | Bhatia | G06F 3/016 340/407.1 |
| 2012/0306631 | A1 | 12/2012 | Hughes | |
| 2013/0106691 | A1 | 5/2013 | Rank | |
| 2013/0318438 | A1 | 11/2013 | Afshar | |
| 2014/0056461 | A1* | 2/2014 | Afshar | H04R 1/00 381/385 |
| 2014/0070957 | A1* | 3/2014 | Longinotti-Buitoni | A61B 5/6804 340/870.01 |
| 2014/0292501 | A1 | 10/2014 | Lim et al. | |
| 2015/0072738 | A1* | 3/2015 | Mankowski | G08B 6/00 455/566 |

FOREIGN PATENT DOCUMENTS

| | | | | |
|---|---|---|---|---|
| EP | 2612510 | | 7/2013 | |
| EP | 3002958 | A1 | 4/2016 | |
| KR | 1020130036766 | A | 4/2013 | |
| WO | 2003032289 | A1 | 4/2003 | |
| WO | 2012028973 | A1 | 3/2012 | |
| WO | 2012029009 | A1 | 3/2012 | |
| WO | 2013118122 | A1 | 8/2013 | |
| WO | 2014130946 | A2 | 8/2014 | |
| WO | WO 2014/130946 | * | 8/2014 | H04W 88/04 |
| WO | 2016147170 | A1 | 9/2016 | |
| WO | 2016147171 | A1 | 9/2016 | |

OTHER PUBLICATIONS

Written Opinion dated Oct. 31, 2016 from International Application PCT/US2016/048057, 7 pgs.

* cited by examiner

DEVICES, SYSTEMS, AND METHODS FOR VIBRATIONALLY SENSING AUDIO

CROSS-REFERENCE TO RELATED APPLICATIONS

This application claims priority to U.S. provisional patent application Ser. No. 62/207,819, filed Aug. 20, 2015, which is herein incorporated by reference in its entirety.

TECHNICAL FIELD

This disclosure relates generally to the field of consumer electronics, and more specifically to the field of experiential audio. Described herein are devices, systems, and methods for vibrationally sensing music.

BACKGROUND

Historically, people have experienced music using their sense of hearing. Earbuds, speakers, and other audio emitting devices are positioned proximate or in (e.g., ears) the body of the user to allow the user to experience the audio (e.g., music) by hearing.

However, people also love the experience of live music, in part because they love how the music feels as it resonates through the body. Current systems and devices that allow a user to feel music are limited to devices that take an entire audio output and activate an actuator (e.g., for vibration) corresponding to particular features of the audio or fluctuations in the audio. In some cases, these systems and devices are mounted in garments, in or on furniture, or in rooms. Although these devices may allow a person to experience music on the go, these systems and devices do not allow a user to haptically experience the complexity and intensity of the music at various octaves, frequencies, and powers at various sites on the body.

Thus, there is a need for new and useful devices, systems, and complex or sophisticated methods for vibrationally sensing audio.

SUMMARY

One aspect of the present disclosure is directed to a system for vibrationally sensing audio. In some embodiments, the system includes a vibration output device. In some embodiments, the vibration output device includes a haptic actuator; a haptic actuator driver coupled to the haptic actuator; an antenna configured to communicatively receive a haptic pattern from a base unit; and a processor coupled to the antenna and haptic actuator driver. In some embodiments, the haptic pattern includes at least one frequency range. In some embodiments, when a total audio power in the at least one frequency range reaches a threshold, the processor activates the haptic actuator driver to drive the haptic actuator to produce vibration on a surface.

In some embodiments, the antenna includes a node configured to receive a wireless multicast radio signal from the base unit.

In some embodiments, the system further includes a plurality of vibration output devices. In some such embodiments, each of the plurality of vibration output devices are configured to receive a multicast radio signal from the base unit. Further, in some such embodiments, each of the plurality of vibration output devices are activated in a predetermined pattern to produce the vibration on the surface.

In some embodiments, the pre-determined pattern is based on a relative location of the plurality of vibration output devices to each other.

In some embodiments, a relative size of each vibration output device is dependent on one or more of: a frequency range transmitted to the vibration output device, a number of haptic actuators in the vibration output device, and a recommended location of the vibration output device relative to the surface.

In some embodiments, the system further includes the base unit. In some embodiments, the base unit includes a base unit processor configured to receive an audio signal from an audio emitting device and process the audio signal into the haptic pattern. In some embodiments, the base unit processor includes a digital signal processor. In some embodiments, the base unit processor transmits the haptic pattern to the vibration output device.

In some embodiments, the system further includes a plurality of vibration output devices.

In some embodiments, the system further includes an audio emitting device. In some embodiments, the audio emitting device includes one of: a computing device, a radio, a television, a stereo, a speaker, and a subwoofer.

In some embodiments, the surface includes one of: a body surface of a user, an inanimate object surface, and a water surface. In some embodiments, the body surface includes one of: a lumbar region, a neck region, an arm region, a leg region, a stomach region, a chest region, a back region, a torso region, and a head region of the user.

In some embodiments, the system further includes a housing disposed around the haptic actuator, haptic actuator driver, antenna, and processor. In some embodiments, the housing includes a smooth surface. In some embodiments, the housing has an appearance of one or more of: a stone, a pebble, a rock, a boulder, a gemstone, and a crystal. In some embodiments, the housing is one or more of: water proof and hermetically-sealed.

In some embodiments, the system further includes a power supply rechargeable by one of: induction charging, resonant energy transfer, and alternating current via a wired connection.

In some embodiments, the haptic actuator includes a plurality of haptic actuators. In some such embodiments, each of the plurality of haptic actuators are activated in response to a different frequency range reaching the threshold.

In some embodiments, the system further includes a garment configured for receiving the vibration output device in a pocket therein.

BRIEF DESCRIPTION OF THE DRAWINGS

The foregoing is a summary, and thus, necessarily limited in detail. The above-mentioned aspects, as well as other aspects, features, and advantages of the present technology are described below in connection with various embodiments, with reference made to the accompanying drawings.

Figure 1:
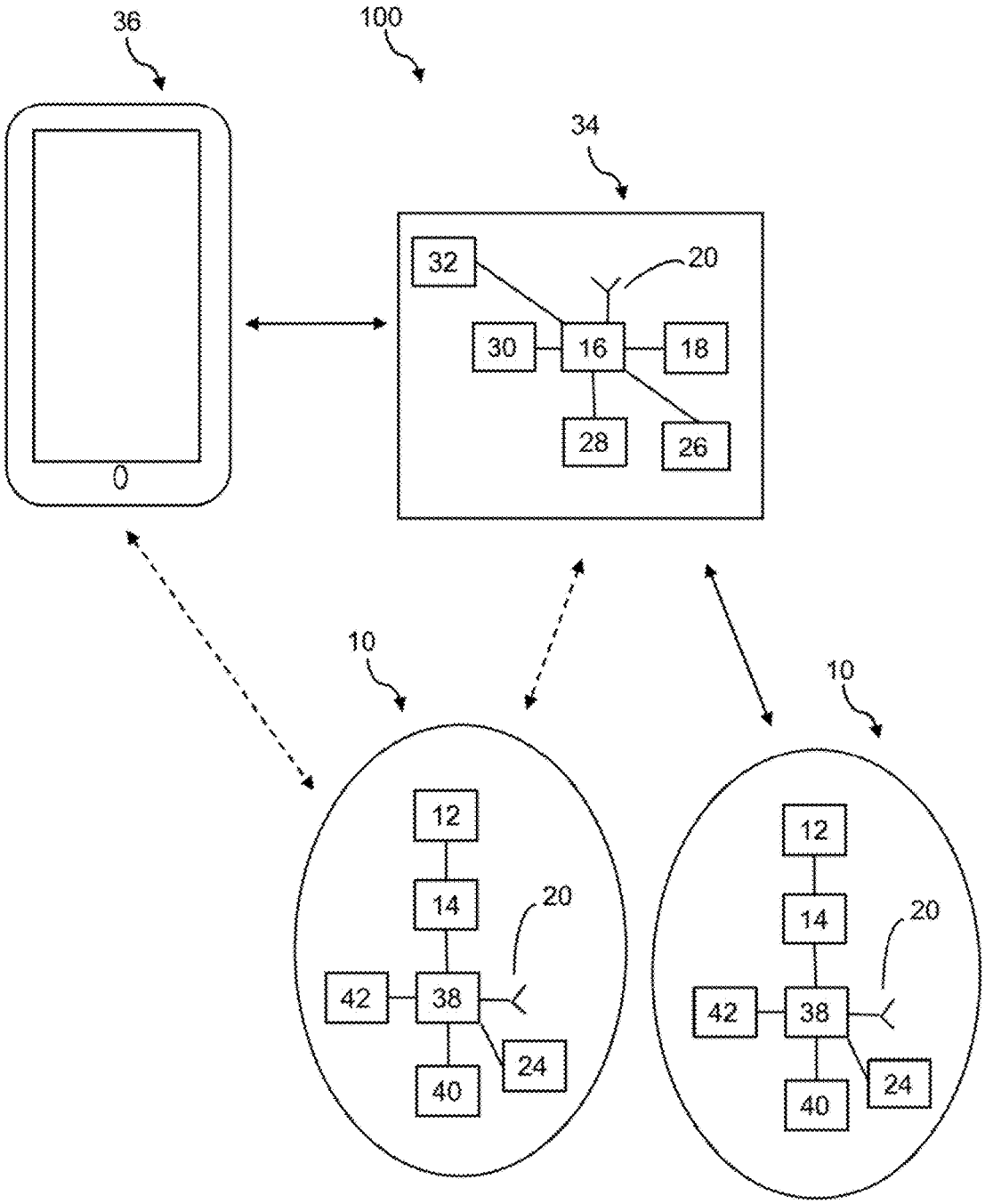
FIG. 1 illustrates a schematic block diagram of one embodiment of a system for vibrationally sensing audio.

The illustrated embodiments are merely examples and are not intended to limit the disclosure. The schematics are drawn to illustrate features and concepts and are not necessarily drawn to scale.

DETAILED DESCRIPTION

The foregoing is a summary, and thus, necessarily limited in detail. The above mentioned aspects, as well as other aspects, features, and advantages of the present technology will now be described in connection with various embodiments. The inclusion of the following embodiments is not intended to limit the disclosure to these embodiments, but rather to enable any person skilled in the art to make and use the contemplated invention(s). Other embodiments may be utilized and modifications may be made without departing from the spirit or scope of the subject matter presented herein. Aspects of the disclosure, as described and illustrated herein, can be arranged, combined, modified, and designed in a variety of different formulations, all of which are explicitly contemplated and form part of this disclosure.

Disclosed herein are devices, systems, and methods for vibrationally sensing audio. In general, the devices, systems, and methods described herein provide interactive, wireless, vibrational, wearable sound resonant devices designed to translate an audio signal into physical vibrational sensations to complement the audio sound listening experience.

In general, a user of such devices, systems, and methods may include a music enthusiast, a recording artist, a musician, a soloist, a band or orchestra, a concert attendee, a vocalist, a singer, a songwriter, a deaf individual, or any other person interested in feeling music or other sound. A user of the devices, systems, and methods described herein can listen to music or any sound generation (e.g., via headphones, earbuds, audio speakers, or by any means desired) while simultaneously feeling the translated vibrations of that processed signal on his or her body.

As described herein, a vibration output device may be worn by a user. A single vibration output device or a plurality of vibration output devices may be worn at various locations on the user's body through a variety of wearable delivery mechanisms, as described elsewhere herein. For example, one or more vibration output devices may be worn on or coupled to a neck region, collar region, head region, arm region, leg region, torso region, stomach region, chest region, back region, lumbar region, or any other body region of a user. In some embodiments, a device for vibrationally sensing audio may be worn on or coupled to a body region of a user comprising a mucous membrane (e.g., mouth). In some embodiments, a plurality of vibration output devices form a vibration output device array, which includes a minimum of two vibration output devices receiving the processed signal.

As described herein, a device for vibrationally sensing audio may be positionable proximate (i.e., on or near) a user. In some embodiments, a device for vibrationally sensing audio may be positioned on or coupled to furniture (e.g., a sofa, bed, coffee table, etc.), a wall, a desk, any other inanimate object in proximity to a user, or submerged in water in proximity to the user.

As described herein, an "audio signal" refers to a single tone, multiple recorded tracks, or a complex amalgam of elements, as in recorded music. As described herein, the audio signal is identified, processed into a haptic pattern, and distributed to one or more vibration output devices.

In some embodiments, a user may use the devices, systems, and methods described herein at a live music performance and/or at a concert venue. In some such embodiments, the live music performance location or concert venue may wirelessly transmit an audio transmission, for example, for use with the devices, systems, or methods described herein. A user may receive the audio transmission via his or her mobile device, and the audio transmission may be processed into a plurality of vibrational sensations that the user can experience. In some embodiments, the performing musician(s) may dictate how the audio signal is processed and/or the vibrational sensations that the users feel and experience.

In some embodiments, a user may use the devices, systems, and methods described herein, in coordination with one or more mapping and/or navigational applications. In some such embodiments, a vibration output device may elicit varied vibrational responses related to destination goals and/or directional guidance.

In some embodiments, a user may use the devices, systems, and methods described herein in coordination with a gaming platform being used. In some such embodiments, a user may feel complex vibrational sensations related to the virtual environment being experienced through the gaming platform.

In some embodiments, a user may use the devices, systems, and methods described herein in coordination with a home theater system. In some such embodiments, the audio signal, corresponding to the video being played, is processed through the system and the audio signal is physically sensed by a user using one or more vibration output devices positioned on a body surface of the user or positioned proximate the user. In such embodiments, the user has a more interactive experience while viewing a video with enhanced physical vibrational cues coordinated with the visual and audio experience.

Further, in some embodiments, a user may use the devices, systems, and methods described herein in coordination with a public movie house or theater's audio system. In some such embodiments, the public movie house or theatre may be equipped to wirelessly transmit an audio signal corresponding to the video being played. The wireless audio signal may be received by one or more vibration output devices positioned on a body surface of the user or positioned proximate the user. In such embodiments, the user has a more interactive experience while viewing a video with enhanced physical vibrational cues coordinated with the visual and audio experience.

In some embodiments, a user may use the devices, systems, and methods described herein in medical applications. For example, one or more vibrational output devices may be applied to various locations on the human body in order to entrain that location to a particular vibrational frequency.

Systems and Devices

FIG. 1 illustrates a functional block diagram of a system 100 for vibrationally sensing audio. Although FIG. 1 depicts various elements associated with various devices, it will be appreciated by one of skill in the relevant art that various elements may be associated with different devices than what is depicted without departing from the original scope and intent of the present disclosure.

As shown in FIG. 1, a system 100 for vibrationally sensing audio includes a base unit 34, one or more vibration output devices 10, and in some embodiments, an audio-emitting device 36. The system 100 functions to process audio signals and distribute audio signals to one or more vibration output devices 10 to be vibrationally sensed by a user. In some embodiments, there is bidirectional communication between system components, for example wireless or wired bidirectional communication between the audio emitting device 36 and the base unit 34, the base unit 34 and one or more vibration output devices 10, and/or the audio emitting device 36 and one or more vibration output devices 10. For example, a base unit 34 may transmit one or more frequency ranges to a vibration output device 10 while the vibration output device 10 transmits location information, a unique identifier, or power supply level information to the base unit 34. Wireless communication may include, but not be limited to, a multicast network (e.g., ANT radio), Bluetooth, low energy Bluetooth, near-field communication, infrared, WLAN, Wi-Fi, CDMA, LTE, other cellular protocol, other radiofrequency, or another wireless protocol. Communication occurring via a wired connection may include, but not be limited to, IEEE 1394, Thunderbolt, Lightning, DVI, HDMI, Serial, Universal Serial Bus, Parallel, Ethernet, Coaxial, VGA, or PS/2.

As shown in FIG. 1, a system 100 for vibrationally sensing audio may include a base unit 34. The base unit 34 functions to receive an audio input, process one or more audio signals into one or more frequency ranges (i.e., a haptic pattern), and dispatch the haptic pattern to one or more vibration output devices 10. The base unit 34 comprises a processor 16, memory 18, an audio input/output port or ports 32, a multicast radio or antenna 20, a power supply 26, a visual indicator 28, and an audio codec 30.

In some embodiments, the base unit 34 and the vibration output device 10 each include a processor 16, 38. The processor 16, 38 may be a digital signal processor (DSP), a general purpose microprocessor, a field programmable gate array (FPGA), an application specific integrated circuit (ASIC), or other programmable logic device. In one embodiment of the base unit 34, the processor 16 is a digital signal processor. The processor 16 of the base unit 34 functions to receive an audio signal from an audio emitting device 36, process the audio signal into one or more frequency ranges (i.e., a haptic pattern), and wirelessly transmit the haptic pattern to one or more vibration output devices 10. The processor 38 of the vibration output device 10 functions to receive the haptic pattern from the base unit 34 and transmit the one or more frequency ranges of the haptic pattern to the haptic actuator driver 14, which in turn, activates the haptic actuator 12, as described in further detail elsewhere herein.

As shown in FIG. 1, each processor 16, 38 is coupled to memory 18, 24 to be able to read information from, and optionally write information to, the memory 18, 24. In some embodiments, the memory 18, 24 is a computer-readable medium that stores computer-readable instructions for execution by a processor 16, 38. For example, the computer-readable medium may include one or more of RAM, ROM, flash memory, EEPROM, a hard disk drive, a solid state drive, or any other suitable device. In some embodiments, the computer-readable instructions include software stored in a non-transitory format. The software may be programmed into the memory 18, 24 or downloaded as an application onto the memory 18, 24. When executed by the processor 16, 38, the programs or applications may cause the processor 16, 38 to perform a method of vibrationally sensing audio as described elsewhere herein.

In some embodiments, as shown in FIG. 1, the base unit 34 includes an audio input and/or audio output port 32. The audio input port 32 of the base unit 34 receives an audio output from an audio emitting device 36 communicatively connected to the base unit 34. The audio emitting device 36 may be connected to the base unit 34 via a wired connection or using a wireless network. In some embodiments, the audio output port 32 transmits audio to one or more speakers, earbuds, or other audio emitting device coupled to the base unit 34. For example, a user may listen to the music by connecting a set of earbuds to the audio output port 32 of the base unit 34 while vibrationally sensing the audio using one or more vibration output devices 10 wirelessly connected to the base unit 34.

In some embodiments, the base unit 34 and vibration output device 10 each include a multicast radio or antenna 20. In some such embodiments, the multicast radio or antenna 20 of the base unit 34 is configured to transmit a haptic pattern, comprising one or more frequency ranges, to a vibration output device 10. The antenna or node 20 of the vibration output device 10 is configured to receive the transmitted haptic pattern from the base unit 34, as described in further detail elsewhere herein. In one embodiment, the multicast radio 20, for example an ANT radio (i.e., 2.4 GHz network), of the base unit 34 is configured to transmit the haptic pattern to a plurality of vibration output devices 10 communicatively coupled to the base unit 34, such that each vibration output device uses a subset of the haptic pattern or the entire haptic pattern to transmit vibration to a surface. Further, in some embodiments in which the base unit 34 is wirelessly connected to the audio emitting device 36, the antenna 20 functions as a receiver to receive audio signals from the audio emitting device 36.

In some embodiments, the base unit 34 wirelessly transmits one or more data packets to one or more vibration output devices. Each data packet may include a haptic pattern. The haptic pattern comprises one or more frequency ranges processed from the audio signal. The haptic pattern may be dependent on a complexity and/or type of the audio signal. In some embodiments, the haptic pattern further includes a target time date or fire date to indicate when a haptic event should be initiated (i.e., activating the haptic actuator driver to activate the haptic actuator), such that one or more vibration output devices are activated simultaneously, sequentially, in an ordered sequence, or randomly. In some embodiments, a data packet may include zero haptic information if the frequency range was absent from the audio signal or a total audio power of a frequency range did not reach a predetermined threshold.

For example, in some embodiments, the base unit 34 wirelessly (e.g., via ANT radio) transmits one data packet to a plurality of vibration output devices, such that each vibration output device processes the data packet to identify which frequency range or frequency ranges it is configured to use. Alternatively, in some embodiments, the base unit 34 transmits one or more data packets to each vibration output device 10, such that each data packet comprises a set of frequency ranges that the vibration output device 10 is configured to use, for example a subset of the total frequency ranges or the entirety of the total frequency ranges.

In some embodiments, as shown in FIG. 1, the base unit 34 includes a power supply 26. The power supply 26 may include a battery or capacitor to provide power to the other electronic components. For example, the power supply 26 may include a rechargeable (e.g., lithium ion) or disposable (e.g., alkaline) battery.

In some embodiments, as shown in FIG. 1, the base unit 34 includes a visual indicator 28. The visual indicator 28 functions to indicate a status of the base unit 34. For example, the visual indicator 28 may indicate an operational status (e.g., on or off) of the base unit 34, an update status (e.g., needs updating or up-to-date), a signal strength status (e.g., for Wi-Fi), a connection status (e.g., connected or not connected to one or more vibration output devices), a power status (e.g., needs charging or completely charged), a genre of the audio signal (e.g., a color assigned to each genre), or any other indicator. The visual indicator 28 may include a light emitting-diode (LED), an organic LED, a fluorescent light, incandescent light, or any other type of visual indicator.

In some embodiments, as shown in FIG. 1, the base unit 34 includes an audio coder 30. The audio coder 30 functions to compress and decompress the audio signal to represent the high-fidelity audio signal with a minimum number of bits while retaining the quality. In some such embodiments, the audio cadre 30 reduces the storage space and the bandwidth required for transmission of the haptic pattern (processed from the audio signal) to e or more vibration output devices 10.

In some embodiments, as shown in FIG. 1, a system 100 for vibrationally sensing audio includes an audio emitting device 36. The audio emitting device 36 functions to transmit an audio signal to the base unit 34 and/or to one or more vibration output devices 10 via a wired or wireless connection, hi some embodiments, an audio emitting device 36 includes a speaker, a computing device (e.g., mobile or stationary, mobile device, tablet, netbook, notebook, wearable device, laptop, desktop, personal digital assistant, etc.), a musical instrument, a band, a soloist, a performer, a base, a subwoofer, a radio, a television, or any other audio emitting device, person, or object. In some embodiments, the audio emitting device 36 comprises one or more signal processing components (e.g., processor, audio codec, memory) to process the audio signal for distribution to one or more vibration output devices 10.

In some embodiments, as shown in FIGS. 1-4B, a system 100 for vibrationally sensing audio comprises one or more, vibration output devices 10. The vibration output device 10 functions to receive a haptic pattern from the base unit 34 or audio emitting device 36 and produce vibration on a surface using a subset of the haptic pattern or the entirety of the haptic pattern to activate the haptic actuator driver which, in turn, activates the haptic actuator. A haptic pattern comprises one or more frequency ranges that may vary in intensity, frequency, power, and/or duration.

Figure 2:
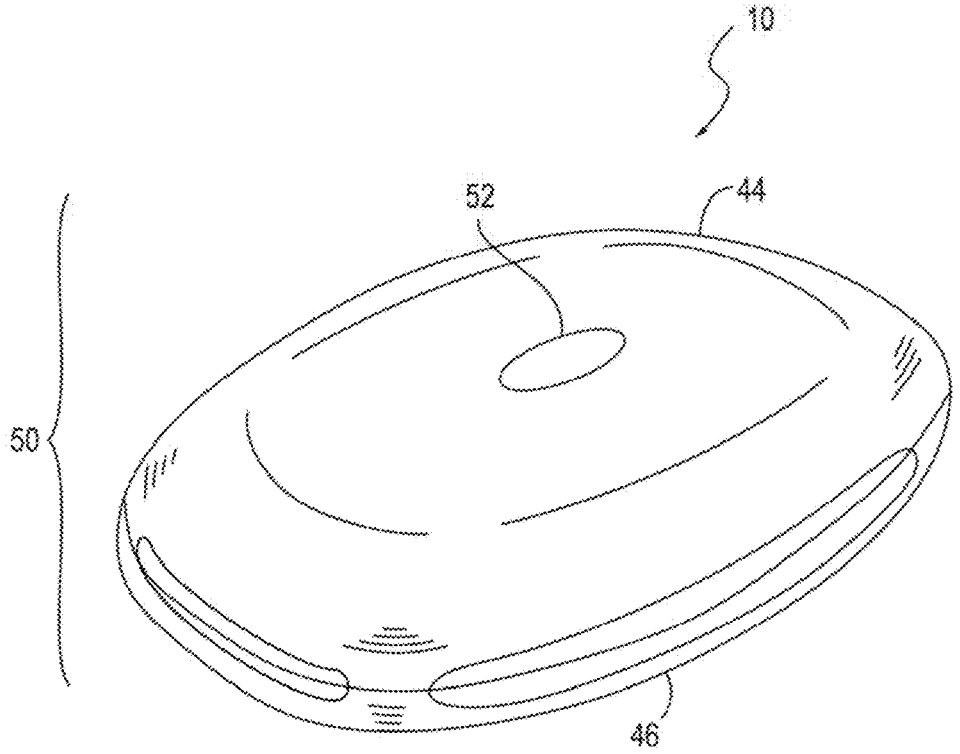
FIG. 2 illustrates a perspective view of one embodiment of a device for vibrationally sensing audio.
Figure 3B:
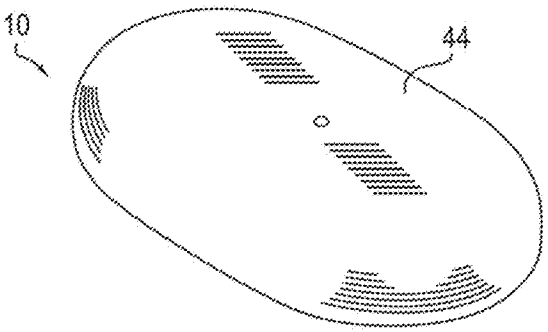
FIG. 3B illustrates a top right side perspective view of one embodiment of a device for vibrationally sensing audio.
Figure 3D:
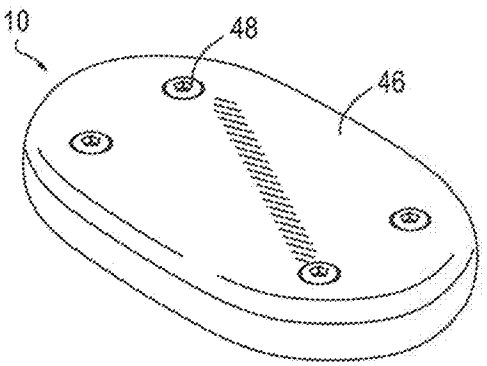
FIG. 3D illustrates a bottom right side perspective view of one embodiment device for vibrationally sensing audio.
Figure 3A:
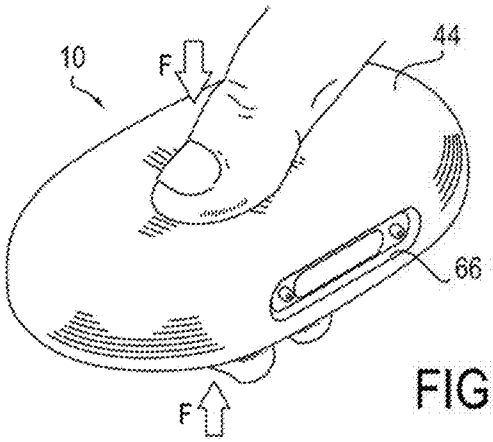
FIG. 3A illustrates a top left side perspective view of one embodiment of a device for vibrationally sensing audio.
Figure 3C:
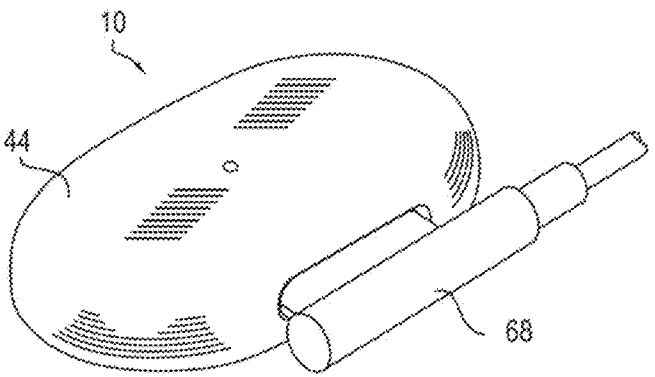
FIG. 3C illustrates a top left side perspective view of one embodiment of a device for vibrationally sensing audio connected to a charging cable.
Figure 4A:
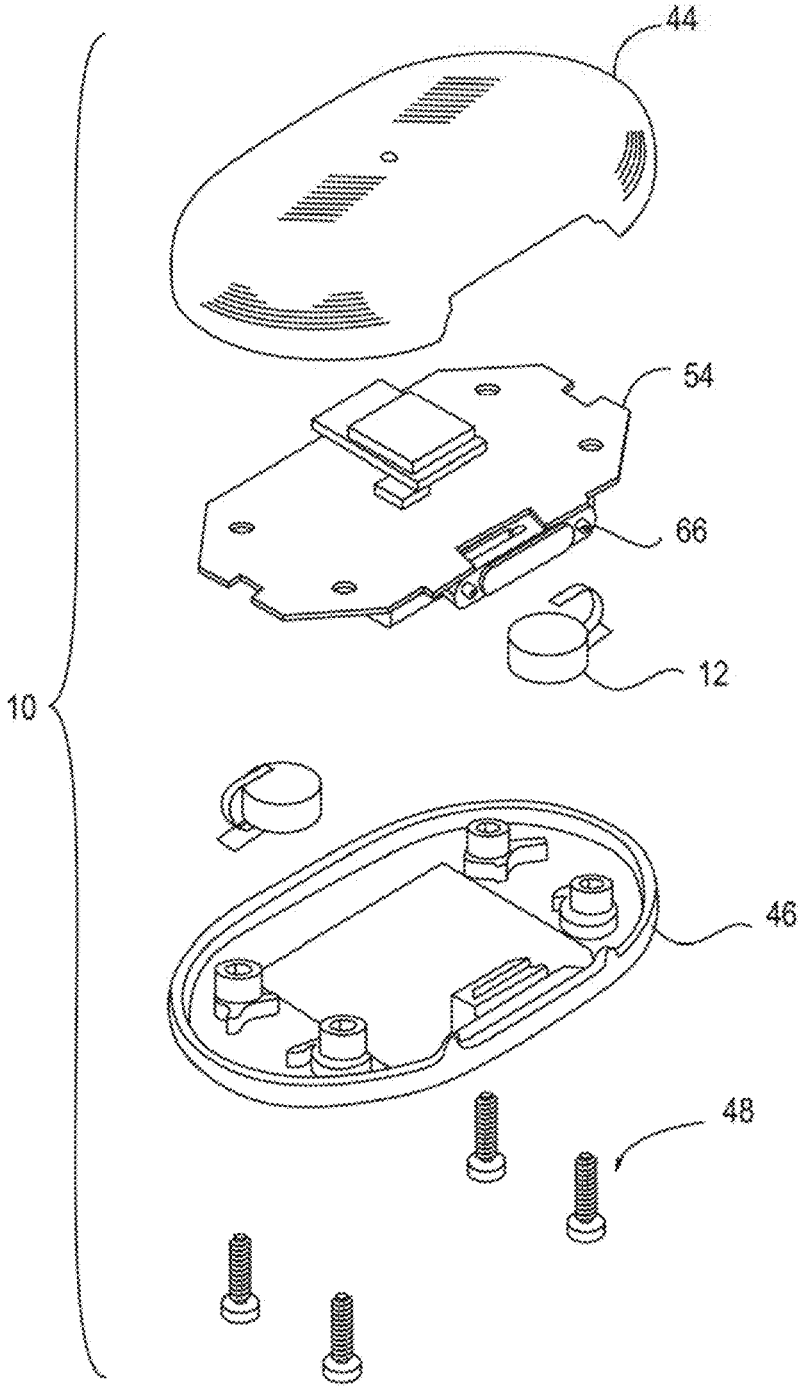
FIG. 4A illustrates an exploded top view of one embodiment of a device for vibrationally sensing audio.
Figure 4B:
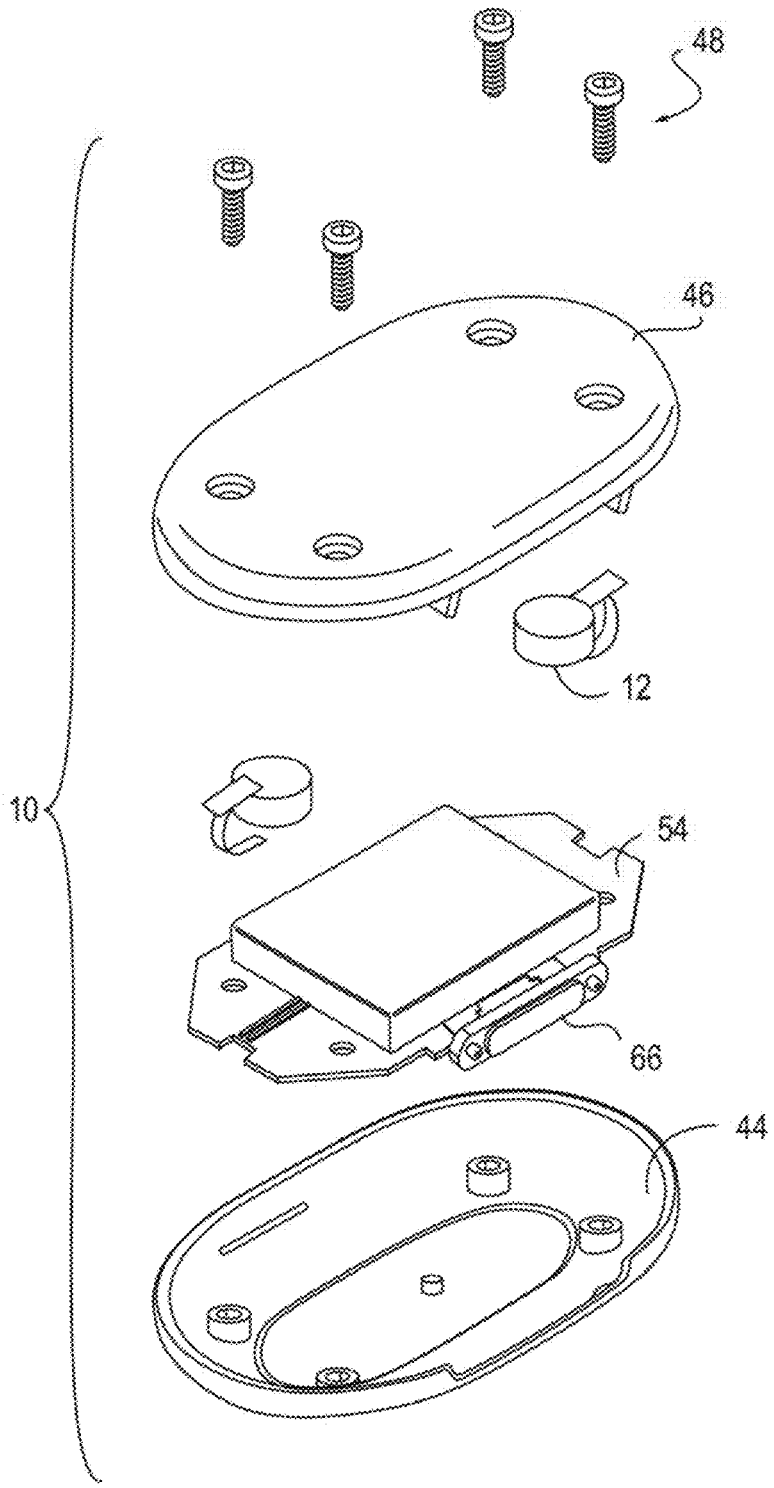
FIG. 4B illustrates an exploded bottom view of one embodiment of a device for vibrationally sensing audio.
Figure 5:
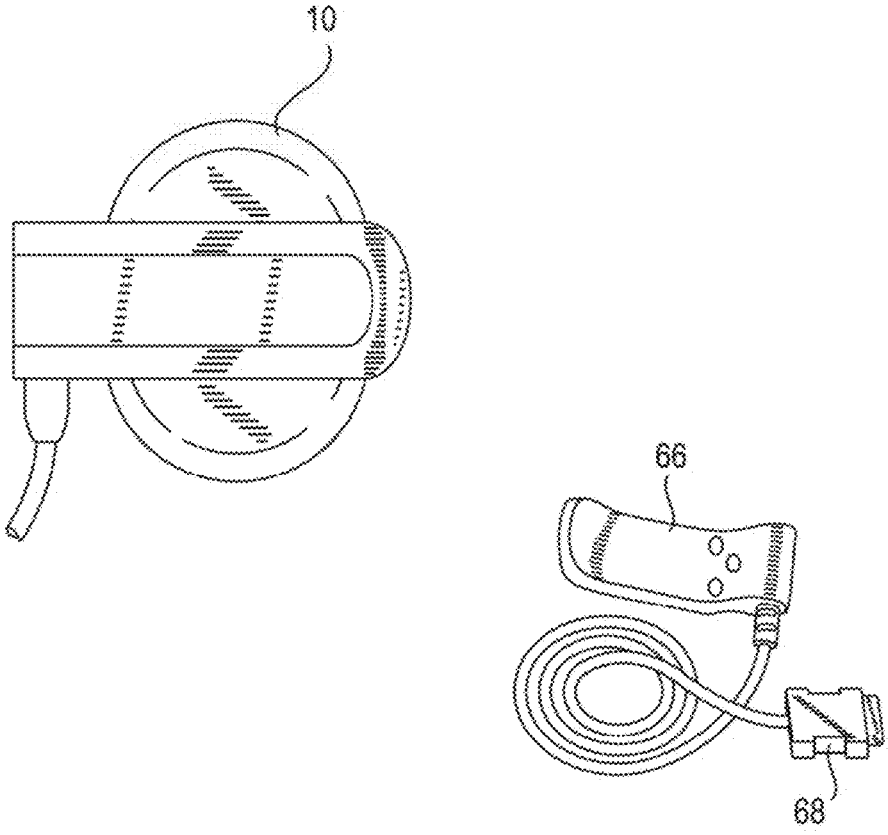
FIG. 5 illustrates one embodiment of a charging apparatus for charging a device for vibrationally sensing audio.

As shown in FIGS. 2 and 4A-4B, a vibration output device 10 comprises first side wall 44 and a second sidewall 46. The first and second sidewalk 44, 46 when coupled together, form a housing 50 configured to house one or more system components (e.g., a haptic actuator, a haptic actuator driver, a processor, an antenna, and/or a power supply). The first and second sidewalls 44, 46 may be coupled together via a snap-fit mechanism, a threading mechanism, with one or more screws 48 (e.g., FIGS. 4A-4B), or via any other coupling mechanism. The first and second sidewalls 44, 46, when coupled together, may form a cavity or housing 50 and, in some embodiments, an airtight or hermetic cavity housing 50 for housing one or more system components.

In some embodiments, upon coupling the first sidewall 44 to the second sidewall 46, the vibration output device 10 has the physical appearance of a rock, stone, pebble, gemstone, crystal or any type of stone synthesized, manufactured, artificially made or as seen in nature. In some embodiments, the finished texture of the vibration output device 10 is natural, coarse, polished, or smooth in appearance. Further, the vibration output device 10 may include any variation of color and may be translucent, clear, opaque, solid, faded, patterned or mixed. In some embodiments, the vibration output device 10 further includes customizable text, numerical values, or symbols on the device itself or through a digital display on the unit. In some embodiments, the vibration output device 10 further includes a visual indicator 52, for example, to indicate a charge status of the device, an operational status of the device, a connection status of the device, a favorite color of the user, a genre or pace of music, or any other feature.

In some embodiments, when the system 100 comprises two or more vibration output devices 10, each vibration output device 10 may vary in size and dimensions, for example depending on the type of device or the recommended use of the device. Regardless of type, each vibration output device 10 may be any size or volume or possess any variation of dimensional ratios. Dimensional ratios may incorporate but are not limited to those found in Sacred Geometry, the Vesica Pisces, the Golden Ratio, and Harmonic Differentials.

In some embodiments, a type or a characteristic of the vibration output device 10, such as size, may correspond to the frequency range the vibration output device 10 receives and outputs to a surface, for example with larger devices corresponding to lower frequency ranges and smaller devices corresponding to higher frequency ranges. Additionally, different vibration output devices 10 may be best suited for placement on or near different locations of the body or near or on different surfaces, the placement being dependent upon the size and/or frequency response range of the particular vibration output device 10. Further, a quantity and/or size of the haptic actuators disposed in each vibration output device 10 may be dependent on the size of the vibration output device 10 (e.g., larger vibration output devices may comprise more or larger haptic actuators), the frequency range that the vibration output device 10 receives, and/or the location of the vibration output device 10 on the body of a user or in or on a surface.

In one embodiment, one or more vibration output devices 10 may be selected from a range of available vibration output devices 10 that includes: a boulder unit, a "bass" unit, a "treble" unit, and a "mini" unit. These are non-limiting examples and the names, characteristics, and/or sizes of the vibration output devices 10 available in any given system may differ. Additionally, each vibration output device 10 may communicate directly with each other, the base unit 34, and/or the audio emitting device 36.

In one non-limiting example, the "boulder" unit is larger than the "bass" unit, which is larger than the "treble" unit, which is larger than or equal in size to the "mini" unit. The "boulder" unit is configured for optimal placement on inanimate objects (e.g., furniture, bathtubs, swimming pools, hot tubs, water basins, home fixtures, etc.), although placement on a body surface of a user is also contemplated. Further, a "boulder" unit may be of a size that is larger than the "bass" unit and can either have a greater number of haptic actuators or include haptic actuators that are larger in size than those used in the other units described elsewhere herein. A "bass" unit may be larger than a "treble" unit but smaller than a "boulder" unit and may have more haptic actuators than the "treble" unit but fewer than the "boulder" unit. The "bass" unit may be configured for optimal placement on or around the lower back, although placement on any body surface is conceivable. A "treble" unit may be of a size that is slightly smaller than the "bass" unit. A "mini" unit may be of a size that is smaller than the "bass" unit and may have fewer haptic actuators than the "treble" unit. In general, the "mini" unit is configured for optimal placement on or around the neck or collar, although placement on any body surface is conceivable. The sizes and physical descriptions of other units may vary and are not limited to the descriptions illustrated above.

In some embodiments, as shown in FIG. 1, each vibration output device 10 comprises a processor 38, memory 24, a haptic actuator driver 14, a haptic actuator 12, an antenna or node 20 for receiving wireless communications, and a power supply 42. In some embodiments, one or more device components are electrically coupled to a circuit board 54, for example as shown in FIGS. 4A-4B. In some embodiments, each vibration output device 10 comprises a plurality of haptic actuators 12, for example to increase an intensity or complexity of the vibration sensation. In some such embodiments, each individual haptic actuator 12 or a plurality of haptic actuators 12 in a vibration output device 10 may be activated in response to a different frequency range or plurality of frequency ranges to allow the vibration output device 10 to create complex harmonics octaves, and overtone sensations. The processor 38 receives a haptic pattern from the base unit 34, the audio emitting device 36, or another vibration output device 10. The processor 38 processes the haptic pattern to identify one or more frequency ranges to be used by the vibration output device 10 and transmits the one or more frequency ranges to the haptic actuator driver 14, which in turn transmits corresponding information related to voltage, and/or vibrational rates to the haptic actuator 12.

In some embodiments, each vibration output device 10 may perform identically to one or more additional vibration output devices 10 in the system 100. Alternatively, in some embodiments, each vibration output device 10 may receive, using the antenna or node 20, a haptic pattern comprising a specific frequency range or may process the one or more frequency ranges of the haptic pattern differently, such that each vibration output device 10 elicits a unique vibration intensity, duration, power, or pattern. For example, each vibration output device 10 may receive, using the antenna or node 20, a data packet comprising a haptic pattern comprising a plurality of frequency ranges, such that the vibration output device 10 processes, using the processor 38, the data packet to extract the frequency range that the vibration output device 10 requires. Alternatively, each data packet may comprise a haptic pattern comprising one or more frequency ranges specific for a particular vibration output device 10, such that the base unit 34 and vibration output device 10 wirelessly communicate using a specific channel or the vibration output device 10 wirelessly communicates its location or its unique identifier to the base unit 34 to enable the base unit 34 to determine which data packet should be transmitted to each vibration output device 10.

In some embodiments, the haptic actuator 12 comprises one of a linear resonant actuator, an eccentric rotating mass vibration motor, and a piezoelectric actuator. In one non-limiting embodiment, the haptic actuator 12 comprises a linear resonant actuator.

In some embodiments, each vibration output device 10 comprises a power switch. In some such embodiments, the vibration output device 10 may include a programmed vibrational response associated with the "on" function and one associated with the "off" function to indicate to the user that the corresponding mechanism has been performed. In some embodiments, the vibration output device 10 is activated or deactivated by a full compression of the flexible sidewalls 44, 46 of the device, as shown by the force arrows F in FIG. 3A. In some such embodiments, the vibration output device 10 is activated or deactivated by a user gripping the first sidewall 44 and second sidewall 46 and squeezing or compressing them towards each other to compress the vibration output device 10 at its center. This compression may flip an internal switch, depress an internal button, or connect two nodes such that the action activates or disables the vibration output device 10. In some embodiments, the vibration output device 10 comprises a power button or switch positioned along the surface of the device on the first or second sidewall 44, 46 of the device 10, such that applying pressure to the switch activates or disables the vibration output device 10. In some embodiments, a magnetic strip is positioned on a second vibration output device or within a pocket of the wearable delivery mechanism, as described in further detail elsewhere herein, such that the vibration output device 10 may be activated when it comes into proximity with the magnetic strip. When the vibration output device 10 is not in proximity to the magnetic strip, the vibration output device 10 may enter an inactive or sleep mode in which power consumption is negligible.

In some embodiments, as shown in FIGS. 1, 3A, 3C, 5, and 6A-6B, a vibration output device 10 may include a power supply 42. In some such embodiments, the power supply 42 includes a rechargeable battery (e.g., lithium ion). The power supply 42 may be recharged via induction charging (FIGS. 6A-6B), using one or more pin connectors coupled to a power source (FIG. 3C and FIG. 5), a USB port coupled to a power source, or using resonant energy transfer based on oscillating magnetic fields (e.g., WiTricity®).

Figure 6A:
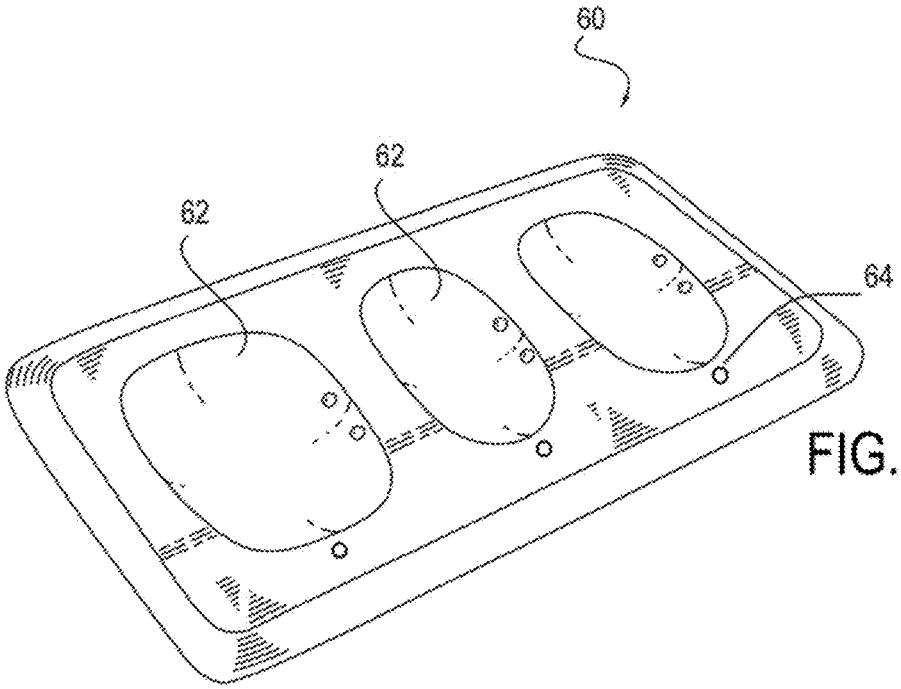
FIG. 6A illustrates one embodiment of a charging apparatus for charging a device for vibrationally sensing audio.
Figure 6B:
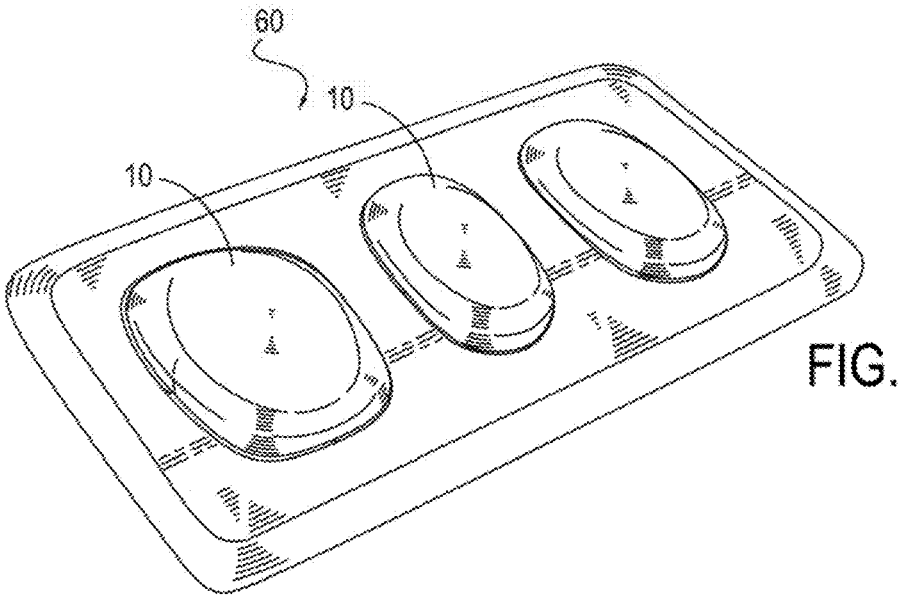
FIG. 6B illustrates one embodiment of a charging apparatus for charging a device for vibrationally sensing audio, wherein the charging apparatus is depicted charging a plurality of vibration output devices.

For example, as shown in FIGS. 6A-6B, for induction charging, a wireless battery housed in the vibration output device 10 is recharged via surface contact between the vibration output device 10 and a charging device 60 through the use of current induction charging technology. An induction charging pad or resonant energy charging pad may include a flat surface or one or more depressions, grooves, or receptacles 62 for receiving a vibration output device 10. A charge status of each of the vibration output devices 10 positioned on the induction charging pad may be indicated by a visual indicator 64, for example, with red indicating uncharged and green indicating fully charged. Alternatively, in some embodiments, the induction charging surface or resonant energy charging surface includes a bowl structure, so that the vibration output devices 10 have an aesthetic appearance (e.g., like rocks in a bowl) while charging.

Further for example, as shown in FIG. 3A, FIG. 3C, FIGS. 4A-4B, and FIG. 5, the vibration output device 10 may include a magnetic multi-pin 66 connecting port or USB port positioned on the first sidewall 44, second sidewall 46, or on a peripheral surface created by coupling the first and second sidewalls 44, 46 together for charging the vibration output device 10 via a wired connection 68. In some embodiments, a combination of power supply recharging processes is incorporated into the vibration output device 10.

As shown in FIGS. 7A-11B, a vibration output device 10 is coupleable to a body surface of a user via a garment 70. Each garment 70 includes one or more stitched pockets, either on the outside or inside of the garment, configured to receive and securely hold a vibration output device 10. The vibration output device 10 may be in close contact with a body surface of the user and may or may not be touching the body surface of the user directly.

Some non-limiting embodiments of garments 70 include: T-shirts (FIGS. 9A-9B), undershirts, compression shirts, tank tops (FIGS. 10A-10B), collared polo shirts, collared dress shirts or any collared button down or pullover shirt, hoodies, sweatshirts, tube tops, bikinis, bathing suits, fabric bandanas, headbands, hats, armbands, vests (FIGS. 7A-8B), harnesses, belts, suspenders, pants, shorts, shoes, socks, leggings, gloves (individual hand and full sleeve gloves), or any custom designed or proprietary garments. Each pocket may include a zipper, Velcro, button, or other feature to close the pocket when the vibration output device 10 is positioned in the pocket. Alternatively, the pocket may remain open when the vibration output device 10 is positioned in the pocket. In some embodiments, a lining of the pocket that contacts a body surface of the user comprises mesh, silk, water-resistant fabric, cotton, or other material that allows the user to feel the vibrations emitted by the vibration output device 10 through the material.

Figure 7A:
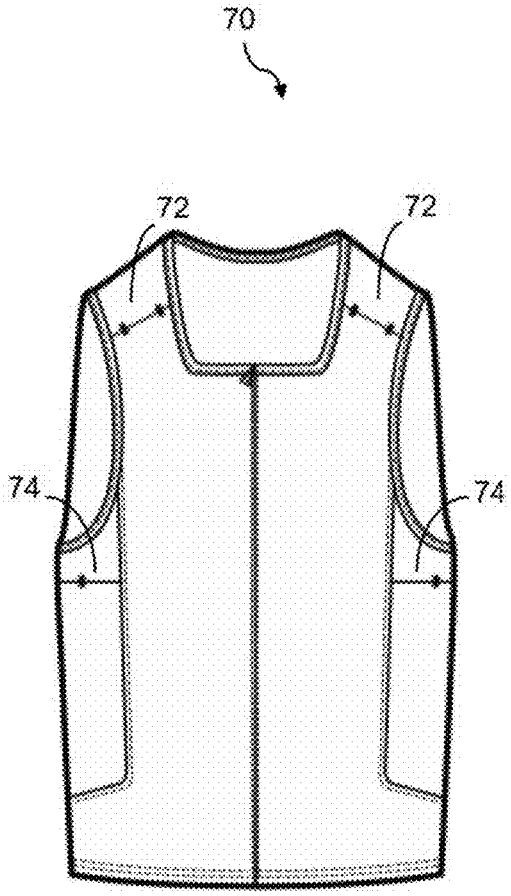
FIG. 7A illustrates a front view of one embodiment of a vest for maintaining a device for vibrationally sensing audio in proximity to a body surface of a user.
Figure 7B:
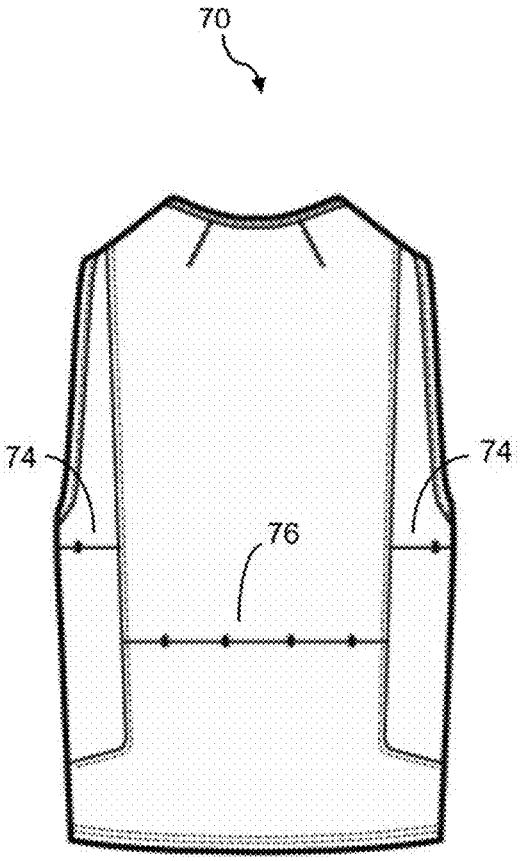
FIG. 7B illustrates a rear view of one embodiment of a vest for maintaining a device for vibrationally sensing audio in proximity to a body surface of a user.
Figure 8A:
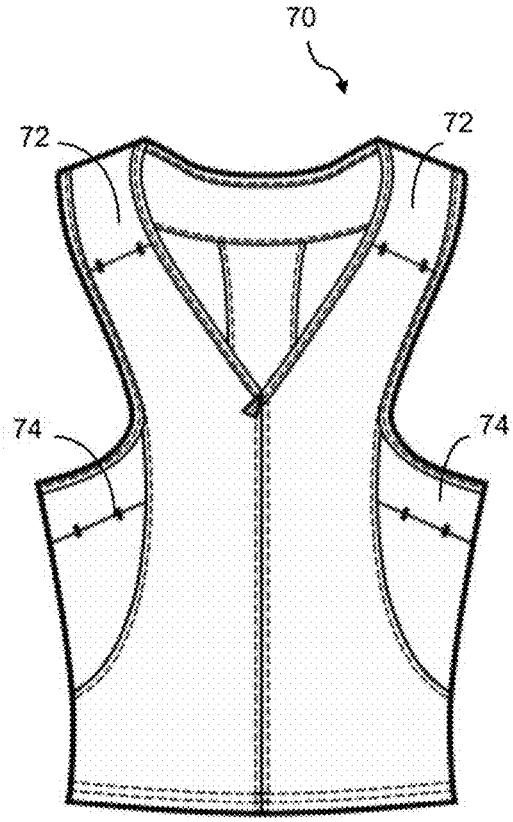
FIG. 8A illustrates a front view of one embodiment of a vest for maintaining a device for vibrationally sensing audio in proximity to a body surface of a user.
Figure 8B:
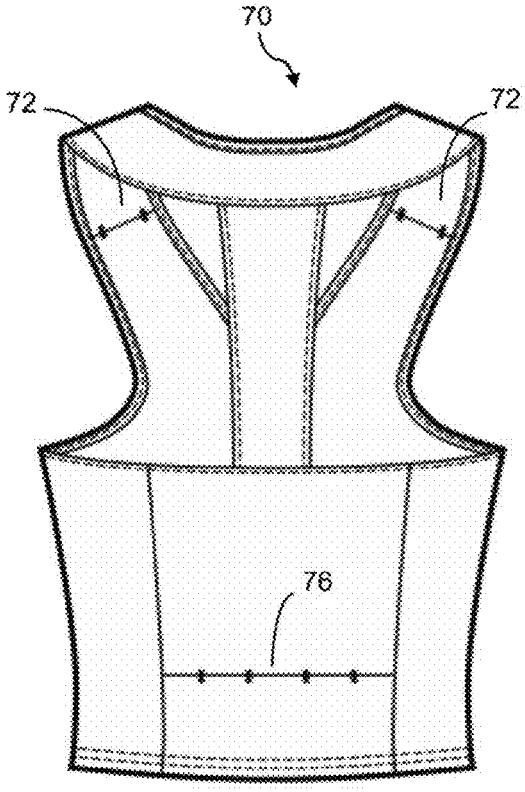
FIG. 8B illustrates a rear view of one embodiment of a vest for maintaining a device for vibrationally sensing audio in proximity to a body surface of a user.

For example, as shown in FIGS. 7A and 8A, the garment 70 includes a shoulder pocket 72 positioned on each shoulder of the vest and an under arm pocket 74 positioned on each side under an arm hole of the vest. As shown in FIGS. 78 and 88, the garment may further include a back pocket 76 positioned on a lower back region of the vest.

Figure 9A:
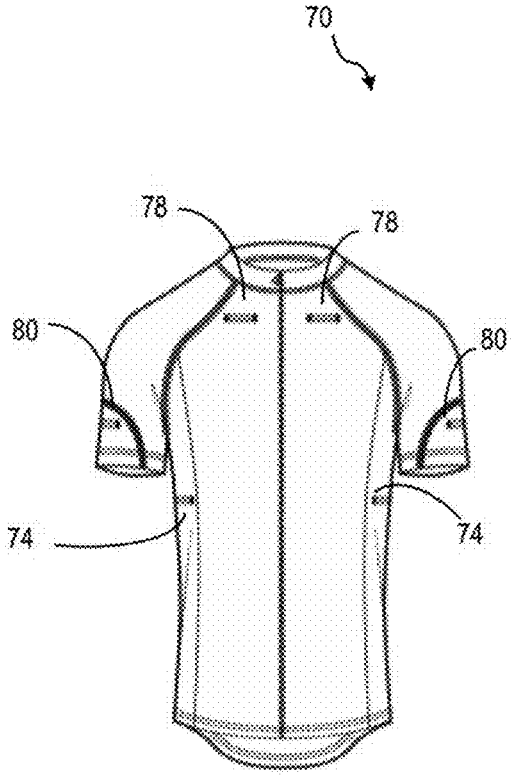
FIG. 9A illustrates a front view of one embodiment of a shirt for maintaining a device for vibrationally sensing audio in proximity to a body surface of a user.
Figure 9B:
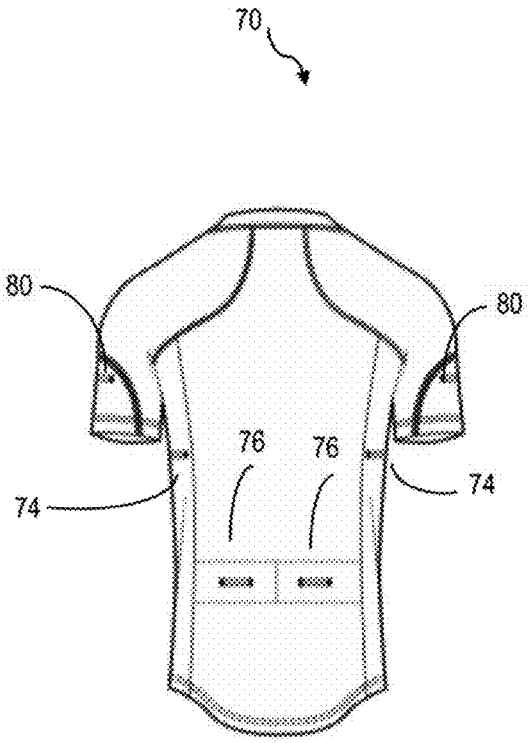
FIG. 9B illustrates a rear view of one embodiment of a shirt for maintaining a device for vibrationally sensing audio in proximity to a body surface of a user.

Further for example, as shown in FIG. 9A, the garment 70 may include a chest pocket 78 positioned on an upper chest region near each shoulder of the t-shirt, a bicep pocket 80 positioned on each sleeve of the t-shirt, and an under arm pocket 74 positioned on each side under an arm hole of the t-shirt. As shown in FIG. 9B, the garment 70 may further include two back pockets 76 positioned on a lower back region of the t-shirt.

Figure 10A:
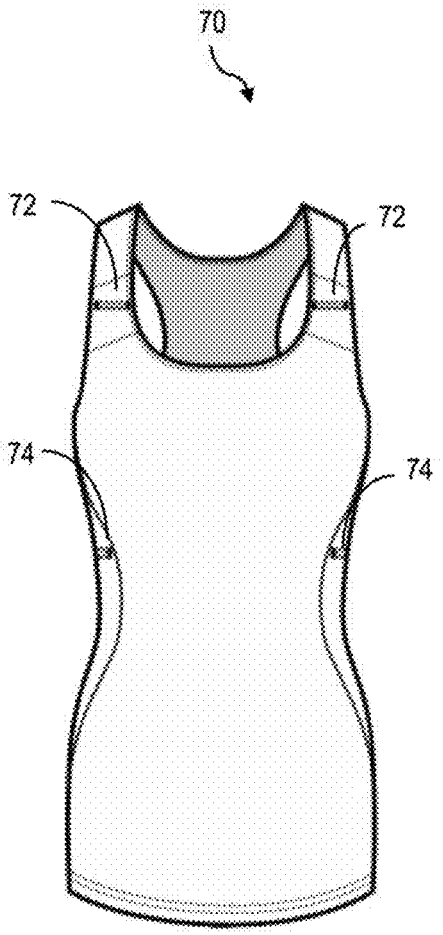
FIG. 10A illustrates a front view of one embodiment of a tank top for maintaining a device for vibrationally sensing audio in proximity to a body surface of a user.
Figure 10B:
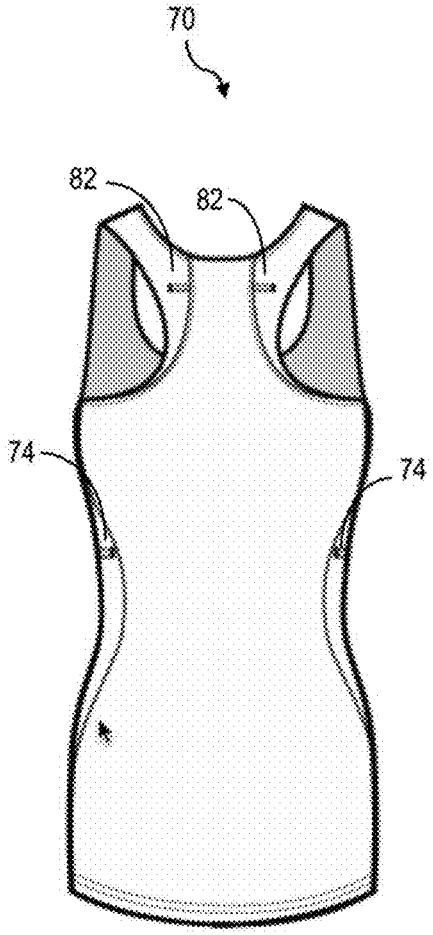
FIG. 10B illustrates a rear view of one embodiment of a tank top for maintaining a device for vibrationally sensing audio in proximity to a body surface of a user.

Further as shown in FIG. 10A, the garment 70 includes a shoulder pocket 72 positioned on each strap of the tank top and an under arm pocket 74 positioned on each side of the tank top under an arm hole of the tank top. As shown in FIG. 10B, the garment 70 may include two upper back pockets 82 on an upper back region of the tank top.

Alternatively or additionally, in some embodiments, a vibration output device 10 is wearable as jewelry. For example, the vibration output device 10 may resemble gemstone jewelry. Non-limiting examples of jewelry configured to couple to a vibration output device 10 include: pendant necklaces, arm bands, wrist bands, belts (looped or high-waisted), body chains, and/or any other type of jewelry.

Alternatively or additionally, in some embodiments, a vibration output device 10 may be directly coupled to a body surface of a user, for example using a skin adhesive patch. In some such embodiments, a non-irritant adhesive is applied to a patch for coupling the vibration output device 10 to a body surface of the user.

Alternatively or additionally, the vibration output device 10 is coupled to a seat cushion or pillow comprising one or more inserts, pockets, or compartments for receiving one or more vibration output devices 10 of varying sizes and/or shapes. In some such embodiments, the vibration output device 10 may vibrate in coordination with the rest of the system 100 and transmit information via vibrational resonance directly to the user who is sitting or sleeping on the pillow or cushion.

Alternatively or additionally, a vibration output device 10 may be submerged in any liquid filled basin (e.g., swimming pool, bathing pool, bath tub, etc.) so that the user may feel the vibrational resonance from the liquid on any body surface of the user.

Methods

Figure 11:
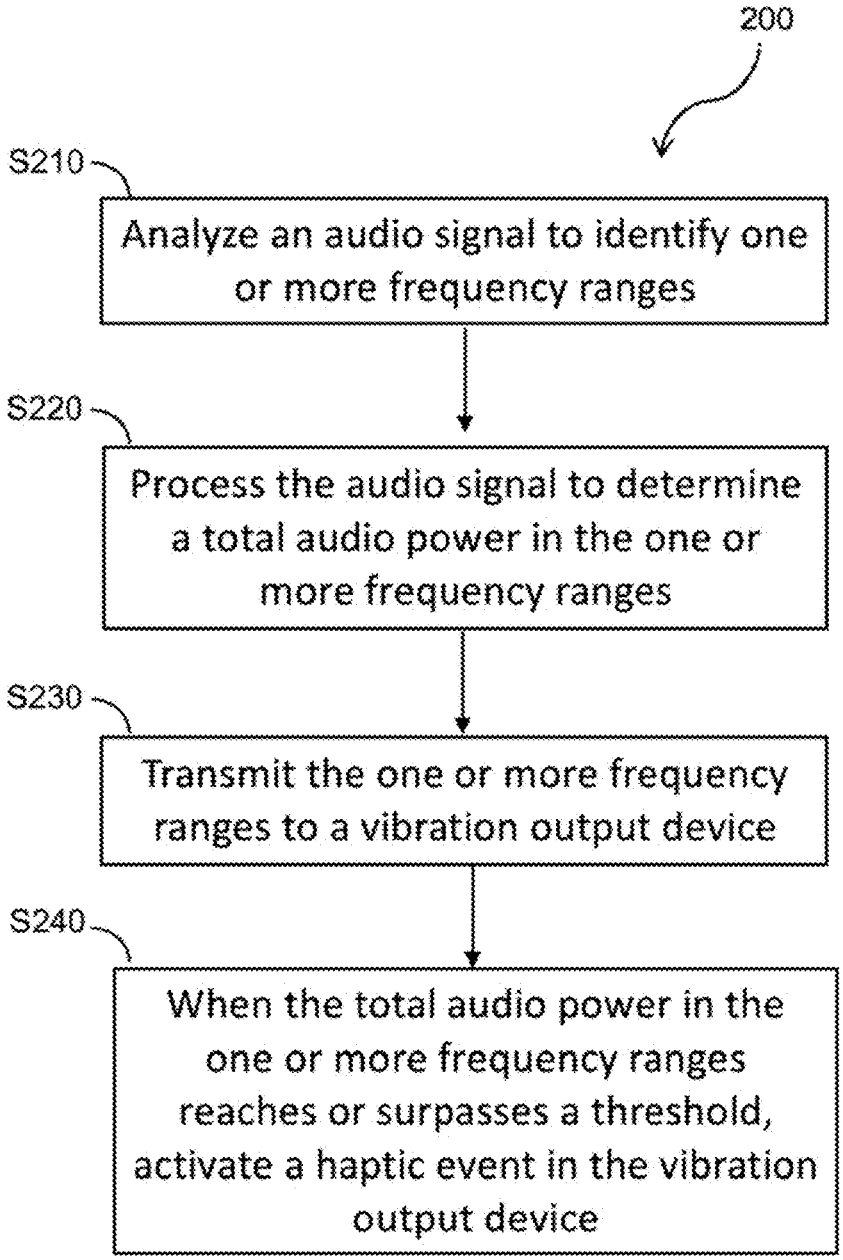
FIG. 11 illustrates a flow chart of one embodiment of a method for vibrationally sensing audio.

As shown in FIG. 11, one embodiment of a method 200 of vibrationally sensing audio includes analyzing an audio signal to identify one or more frequency ranges in block S210, processing the audio signal to determine a total audio power in the one or more frequency ranges in block S220, transmitting the one or more frequency ranges to a vibration output device 10 in block S230, and when the total audio power in the one or more frequency ranges reaches or surpasses a threshold, activating a haptic event in the vibration output device 10 in block S240. The method functions to convert an audio signal received by the base unit 34 or by a vibration output device 10 into one or more frequency ranges that can be haptically transmitted to a surface.

In some embodiments, as shown in FIG. 11, one embodiment of a method 200 of vibrationally sensing audio includes block S210, which recites analyzing the audio signal to identify one or more frequency ranges. Block S210 functions to identify a total frequency range of the audio signal in order to process dynamically the audio signal into specific frequency ranges that together comprise the total frequency range. In some embodiments, block S210 occurs by applying a fast Fourier transform (FFT). For example, using a FFT to define the frequency ranges enables the frequency ranges to be changed dynamically according to a type of audio or music being processed. The type of audio may vary in complexity (e.g., range of frequencies or octaves, amplitude or power of the audio, etc.). Further, in some embodiments, block S210 may include converting the audio signal from a time domain to a frequency domain, for example using a FFT. In some embodiments, block S210 occurs in real time. Alternatively, in some embodiments, a specific set of frequency ranges are predefined in the audio signal to provide a user with a specific experience, for example based on artist preference, user preference, or any other preference or parameter. In some embodiments, block S210 is performed by the base unit 34, an audio emitting device 36, or a vibration output device 10. In one embodiment, block S210 is performed by the base unit 34.

In some embodiments, as shown in FIG. 11, one embodiment of a method 200 of vibrationally sensing audio includes block S220, which recites processing the audio signal to determine a total audio power in the one or more frequency ranges. Block S220 functions to process a specific frequency range to determine a strength or amplitude of the specific frequency range. The total audio power may be determined using root mean square, an average over time in the specific frequency range, or using any other method. In some embodiments, the total audio power of the specific frequency range may dictate which vibration output device 10 receives the haptic pattern, may determine if the specific frequency range is included in the haptic pattern, or may determine if the specific frequency range results in a haptic event in the vibration output device 10. In some embodiments, block S220 is performed by the base unit 34, an audio emitting device 36, or a vibration output device 10. In one embodiment, block S210 is performed by the base unit 34.

In some embodiments, as shown in FIG. 11, one embodiment of a method 200 of vibrationally sensing audio includes block S230, which recites transmitting the one or more frequency ranges to a vibration output device 10. Block S230 functions to ensure that each vibration output device 10 in the system 100 receives a specific frequency range, if the specific frequency range reaches a predetermined threshold. In some embodiments, the method 200 may include transmitting a data packet that comprises a haptic pattern that comprises a plurality of frequency ranges to each vibration output device 10, such that each vibration output device 10 then processes the data packet to determine which frequency range information it needs to transmit to its respective haptic actuator driver or haptic actuator drivers. Alternatively, the method 200 may include transmitting location information or a unique identifier from each vibration output device 10 to the base unit 34, such that the base unit 34 may then transmit a haptic pattern comprising a specific frequency range to each vibration output device 10 based on the location information or the unique identifier. Alternatively, the method 200 may include transmitting, from the base unit 34 using a unique channel, a haptic pattern comprising one or more frequency ranges, such that each vibration output device 10 wirelessly communicates with the base unit 34 using the unique channel. In some embodiments, block S230 is performed by the base unit 34, an audio emitting device 36, or a vibration output device 10. In one embodiment, block S210 is performed by the base unit 34.

In some embodiments, the method 200 includes identifying a location of a first vibration output device relative to a second vibration output device or to a plurality of vibration output devices. Identifying may include transmitting location information or a unique identifier from each vibration output device 10 to the base unit 34. The method 200 may include: adapting a vibration frequency, intensity, length, pattern, or other characteristic elicited by the vibration output device 10 depending on the identified location of the vibration output device, for example relative to other vibration output devices in the system 100.

In some embodiments, the method 200 includes: detecting a plurality of vibration output devices 10; and increasing a complexity of the audio signal or frequency range transmitted to the plurality of vibration output devices 10 to improve a user experience.

In some embodiments, the method 200 includes transmitting the one or more frequency ranges encoded with a target date time or fire date to indicate when a vibration output device 10 should activate a haptic event relative to additional vibration output devices 10 in the system.

In some embodiments, as shown in FIG. 11, one embodiment method 200 of vibrationally sensing audio includes block S240, which recites when the total audio power in the one or more frequency ranges reaches or surpasses a threshold, activating a haptic event in the vibration output device 10 in block S240. Block S240 functions to activate a haptic actuator driver 14 and haptic actuator 12 in response to the vibration output device 10 receiving a frequency range and that frequency range reaching or surpassing a threshold. In some embodiments, one or a plurality of haptic actuators 12 are activated in response to the frequency range reaching a threshold. For example, in a "bass" unit comprising three haptic actuators, all the haptic actuators or a subset thereof may be activated, while in a "mini" unit comprising one haptic actuator 12, the one haptic actuator 12 may be activated. In some embodiments, block S240 is performed by a base unit 34 or a vibration output device 10. In one embodiment, block S240 is performed by a vibration output device 10.

In some embodiments, the method 200 includes transmitting, using the audio emitting device 36, an audio signal to the base unit 34. In some such embodiments, transmitting occurs via a wired connection, as described elsewhere herein.

In some embodiments, activating the haptic event includes eliciting a plurality haptic events in a pattern. For example, a "rise" pattern begins with activating one or more vibration output devices positioned proximal a lower part or portion of the user's body. The vibrational plane moves upward along the user's body activating those vibration output devices 10 in the array (i.e., plurality of vibration output devices) while moving towards the user's head and simultaneously de-activating those vibration output devices 10 below. A "fall" pattern is similar to the "rise" pattern, but in a direction opposite the rise pattern (e.g., a reverse vertical direction downward from head to foot).

A "ring" pattern creates a sensation of a transverse vibrational ring runt a user's body, for example by activating two or more vibration output devices 10 around a torso region of the user.

A "fill" pattern is similar to a "rise" pattern except that as the vibrational patter moves vertically towards the user's head, the lower vibration output devices 10 remain active. When the "fill" pattern is complete, all vibration output devices 10 are active. An "empty" pattern is similar to the "fill" pattern but in the reverse vertical direction. For example, the vibrational pattern begins with the vibration output devices 10 positioned proximal to a user's head and progresses down vertically, activating vibration output devices 10 below the first activated vibration output device 10. When the "empty" pattern is complete, all vibration output devices 10 are active.

A "curtain" pattern begins with all vibration output devices 10 active and vibration output devices 10 begin to reduce vibrational output or shutoff completely as the signal travels from head to foot.

A "ping" pattern uses Short, sharp bursts of vibration to each individual vibration output device 10 for brief moments and then jumps to another vibration output device 10, then to another and so on in coordination with the audio being heard by the user. A "bouncing" pattern is similar to the "ping" pattern but with signal bursts that are less sharp and more elongated with a softer reverberation, creating a sensation of bouncing from one vibration output device 10 to another vibration output device 10 in the array.

A "pendulum" pattern shifts the vibrational movement laterally from a left side to a right side on the user's body or from a right side to a left side of the user's body.

A "bang" pattern is similar to the "ping" pattern but briefer in its sensation and with greater output. A "rapid" pattern induces a rapid fire of focused vibrational output to either an individual vibration output device 10 or an array of vibration output devices 10.

A "boom" pattern is similar to the "bang" pattern but with a wider vibrational distribution surface area. A "shotgun" pattern is a combination of the "bang" pattern and the "boom" pattern.

A "laser" pattern includes a soft, linearly transmitted vibration designed to create a sensation of a laser beam of light.

A "vortex" pattern may be used on both a single vibration output device 10 and in a multiple vibration output device array. The "vortex" pattern mates a swirling pattern either clockwise or counterclockwise within a vibration output device 10 or on the user's entire body through the multiple vibration output device array. A "corkscrew" pattern is similar to the "vortex" pattern but creates a spiraling sensation that terminates at the center of the vibration output device array.

A "godzilla" pattern includes a specified, soft, intermittent rumbling sensation. A "tremor" pattern creates a vibrational sensation of a mild earthquake. A "quake" pattern creates a vibrational sensation of a major earthquake.

A "heartbeat" pattern creates a vibrational sensation of a heart beating. The "heartbeat" pattern may also be associated with a customized dedicated application or as a feature of an application that will allow the user to feel the recreation of another individual's actual heartbeat through the use of sensors.

A "wave" pattern recreates a flowing sensation of sitting on a wave in the ocean or of a wave hitting the body.

A "knocking" pattern creates a sensation of someone knocking on a wooden door.

A "robot" pattern gives the vibration output device array a mechanical, stuttered response to create the feeling of robotic limbs and movements.

A "burst" pattern creates a sensation of an initial impact point with concentric circular patterns emanating outward around the central impact point that slowly degrades the further the vibration output devices 10 are removed from the center. An "explosion" pattern is similar to the "burst" pattern but with higher intensity.

A "droplet" pattern creates a sensation of a drop of liquid impacting a surface, similar to the "burst" pattern but more localized. A "rain storm" pattern includes multiple "droplet" patterns. An "into the water" pattern is similar to the "droplet" pattern but creates a sensation of full body immersion in a liquid.

A "snowflake" pattern creates a light sensation of a snow flake falling on skin.

A "hurricane" pattern creates a sensation of chaotic hurricane wind patterns.

A "trickle" pattern is similar to the "droplet" pattern but lighter in intensity. The "mist" pattern is similar to the "trickle" pattern but lighter in intensity.

A "sunrise" pattern recreates a physical sensation of sunlight touching the skin.

A "flight" pattern uses rapid, high-frequency vibrations to recreate the gravitational forces exerted on a body when traveling laterally through the air at high speeds. A "free fall" pattern is similar to the "flight" pattern but recreates a horizontal dropping sensation, a "launch" pattern is similar to the "free fall" pattern but recreates a horizontal climbing sensation.

In some embodiments, one or more vibration output devices 10 may be synchronized to the audio based on the genre of the audio. Each genre of music has its own instrumental, compositional, and arrangement attributes, which all require different approaches when mastering. Different genres of music utilize a variety of mastering techniques. A genre-specific mode allows a user an easy-to-use pre-fabricated signal processing filter that will automatically adjust an audio signal output and coordinate the performance of the vibration output device 10 to match a corresponding genre of music or audio being played.

For example, in an "instrumental" mode, a user will have the ability to select the instrument or musical element that the user wants to focus on. Once that instrument or element is selected, it will play exclusively throughout the system array with each vibration output device 10 performing the same function. In some embodiments, multiple elements can be selected and assigned to different vibration output devices 10 in the array. Further, an individual vibration output device 10 may isolate an instillment or musical element or all vibration output devices 10 may act in unison as that same isolated element.

A "tone generator" mode transmits pure tones directly from the application to the active vibration output devices 10 in the array. For example, specific frequency tones may be assigned to different vibration output devices 10 or all the active vibration output devices 10 in the array may transmit the same tone in unison.

A "band" mode is designed to meet the needs of live performing artists and musicians. The live music is received as it is being played and then processed through a system application. Each member of a performing group can isolate specific elements of the music being played and have that specific element or elements become the focus of the vibration output device(s) 10 that he or she is wearing. For example, the bass guitarist may isolate the high-hat and bass drum of the drummer and have those two elements processed through his vibration output device(s) 10 during a live performance.

An "ambient mode" processes the audio signal utilizing fewer elements from the music in an attempt to create a light and soothing vibrational sensation that is coordinated with the musical sound being listened to and offers a subtle response with a mild intensity level.

An "all-in-one" mode reduces the complexity and sophistication of the audio signal processing and maintains a uniform vibrational sensation that is consistent and identical across all active vibration output devices 10 in the array.

A "twins" mode is a social networking feature that allows a user, through his or her own system, to feel exactly what another user is experiencing. When in "twins" mode, the user will have the ability to invite others to connect to her or his individual player and feel the same exact sensations that the user's system is creating. "Twins" mode also allows a user-to-user communication platform for sending vibrational signals and messages back and forth to each other or to a group of users.

A "bio-feedback" mode uses a recording of actual or synthesized rhythms of the human body (or other life forms) and recreates those rhythms through audio signal processing. For example, a recording of the human heart can be recorded, processed, and transmitted to the vibration output devices 10 such that the user can feel the recreated beating of that human heart recording. A "bio-feedback" mode may also exist as a separate application to be used for medical or therapeutic devices.

A "nature" mode converts natural elements, sounds, and weather patterns into physical vibrational sensations. Non-limiting examples include: wind, rain, thunder, waterfall, summer night, crashing waves, gentle surf, streams, etc.

The devices, systems, and methods of the embodiments described herein and variations thereof can be embodied and/or implemented at least in part as a machine configured to receive a computer-readable medium storing computer-readable instructions. The instructions are preferably executed by computer-executable components preferably integrated with the system and one or more portions of the processor on the base unit 34, audio emitting device 36, and/or vibration output device 10. The computer-readable medium can be stored on any suitable computer-readable media such as RAMs, ROMs, flash memory, EEPROMs, optical devices (e.g., CD or MD), hard drives, floppy drives, or any suitable device. The computer-executable component is preferably a general or application-specific processor, but any suitable dedicated hardware or hardware/firmware combination can alternatively or additionally execute the instructions.

As used in the description and claims, the singular form "a", "an" and "the" include both singular and plural references unless the context clearly dictates otherwise. For example, the term "vibration output device" may include, and is contemplated to include, a plurality of vibration output devices. At times, the claims and disclosure may include terms such as "a plurality," "one or more," or "at least one;" however, the absence of such terms is not intended to mean, and should not be interpreted to mean, that a plurality is not conceived.

The term "about" or "approximately," when used before a numerical designation or range (e.g., to define a length or pressure), indicates approximations which may vary by (+) or (−) 5%, 1% or 0.1%. All numerical ranges provided herein are inclusive of the stated start and end numbers. The term "substantially" indicates mostly (i.e., greater than 50%) or essentially all of a device, system, or method.

As used herein, the term "comprising" or "comprises" is intended to mean that the devices, systems, and methods include the recited elements, and may additionally include any other elements. "Consisting essentially of" shall mean that the devices, systems, and methods include the recited elements and exclude other elements of essential significance to the combination for the stated purpose. Thus, a device, system, or method consisting essentially of the elements as defined herein would not exclude other materials, features, or steps that do not materially affect the basic and novel characteristic(s) of the claimed disclosure. "Consisting of" shall mean that the devices, systems, and methods include the recited elements and exclude anything more than a trivial or inconsequential element or step. Embodiments defined by each of these transitional terms are within the scope of this disclosure.

The examples and illustrations included herein show, by way of illustration and not of limitation, specific embodiments in which the subject matter may be practiced. Other embodiments may be utilized and derived therefrom, such that structural and logical substitutions and changes may be made without departing from the scope of this disclosure. Such embodiments of the inventive subject matter may be referred to herein individually or collectively by the term "invention" merely for convenience and without intending to voluntarily limit the scope of this application to any single invention or inventive concept, if more than one is in fact disclosed. Thus, although specific embodiments have been illustrated and described herein, any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

What is claimed is:

1. A system for vii rationally sensing audio, the system comprising:

a base unit communicatively coupled to an audio emitting device and configured to process an audio signal emitted by the audio emitting device into one or more frequency ranges and determine a total audio power in the one or more frequency ranges; and a plurality of vibration output devices communicatively coupled to the base unit, wherein each of the vibration output devices is associated with a unique identifier and a respective unique frequency response range, and each of the plurality of vibration output devices comprises a haptic actuator and a haptic actuator driver, and wherein the haptic actuator driver is coupled to the haptic actuator and configured to drive the haptic actuator to produce a vibration on a surface in response to receiving a data packet associated with the unique identifier from the base unit the data packet associated with the unique identifier being indicative of the total audio power in the respective unique frequency response range reaching a threshold.

2. The system of claim 1, wherein the surface comprises one of: a body surface of a user, an inanimate object surface, and a water surface.

3. The system of claim 2, wherein the body surface comprises one of: a lumbar region, a neck region, an arm region, a leg region, a stomach region, a chest region, a back region, a torso region, and a head region of the user.

4. The system of claim 1, wherein each of the plurality of vibration output devices further comprises a power supply rechargeable by one of; induction charging, resonant energy transfer, and alternating current via a wired connection.

5. The system of claim 1, wherein communication between the audio emitting device, the base unit, and the vibration output devices occurs wirelessly.

6. The system of claim 1, further comprising a processor disposed in the base unit, wherein the processor is configured to process the audio signal into the one or more frequency ranges.

7. The system of claim 1, further comprising a processor disposed in the base unit, wherein the processor is configured to determine the total audio power in the at least one of the one or more frequency ranges.

8. The system of claim 1, further comprising the audio emitting device, wherein the audio emitting device comprises one of: a computing device, a radio, a television, a stereo, a speaker, and a subwoofer.

9. The system of claim 1, wherein each of the plurality of vibration output devices further comprises a housing disposed around the haptic actuator and haptic actuator driver.

10. The system of claim 9, wherein the housing comprises a smooth surface.

11. The system of claim 9, wherein the housing has an appearance of one or more of a stone, a pebble, a rock, a boulder, a gemstone, and a crystal.

12. The system of claim 9, wherein the housing is one or more of: water proof and hermetically-sealed.

13. The system of claim 1, further comprising a garment configured to couple one or more of the vibration output devices to a body surface of a user.

14. The system of claim 13, wherein the garment further comprises a pouch or a pocket configured to receive one or more of the vibration output devices.

15. The system of claim 1, wherein the one or more frequency ranges vary in one or more of: intensity, frequency, power, and duration.

* * * * *